US010701996B2

(12) United States Patent
Griffin et al.

(10) Patent No.: US 10,701,996 B2
(45) Date of Patent: Jul. 7, 2020

(54) GARMENT HAVING MOBILITY-ENHANCING ARM PLEAT

(71) Applicant: VF Imagewear, Inc., Nashville, NC (US)

(72) Inventors: David Winfield Griffin, Nashville, TN (US); Dianne Marie Tatara, Nashville, TN (US)

(73) Assignee: VF IMAGEWEAR, INC., Nashville, TN (US)

( * ) Notice: Subject to any disclaimer, the term of this patent is extended or adjusted under 35 U.S.C. 154(b) by 137 days.

(21) Appl. No.: 15/807,070

(22) Filed: Nov. 8, 2017

(65) Prior Publication Data

US 2018/0125135 A1 May 10, 2018

Related U.S. Application Data

(60) Provisional application No. 62/418,917, filed on Nov. 8, 2016.

(51) Int. Cl.

| | |
|---|---|
| ***A41D 27/10*** | (2006.01) |
| ***A41D 27/24*** | (2006.01) |
| ***A62B 17/00*** | (2006.01) |
| ***A41D 13/02*** | (2006.01) |

(52) U.S. Cl.

CPC ..... *A41D 27/10* (2013.01); *A41D 13/02* (2013.01); *A41D 27/24* (2013.01); *A62B 17/003* (2013.01); *A62B 17/001* (2013.01)

(58) Field of Classification Search

CPC ..... A41D 13/02; A41D 27/24; A41D 27/10; A41D 1/04; A41B 1/08

USPC ..... 2/93, 115, 243.1, 244, 458

See application file for complete search history.

(56) References Cited

U.S. PATENT DOCUMENTS

| | | | | |
|---|---|---|---|---|
| 1,177,952 A * | 4/1916 | Inman | A41D 1/02 2/93 |
| 2,291,025 A * | 7/1942 | Casella | A41D 27/10 2/93 |
| 2,777,132 A * | 1/1957 | Keller | A41D 27/10 2/270 |
| 3,654,632 A | 4/1972 | Lacroix | |
| 5,072,454 A | 12/1991 | Trahan | |

(Continued)

FOREIGN PATENT DOCUMENTS

| | | |
|---|---|---|
| CN | 201871145 | 6/2011 |
| WO | 2015034722 | 3/2015 |
| WO | 2015068049 | 5/2015 |

*Primary Examiner* — Katherine M Moran

(74) *Attorney, Agent, or Firm* — McAndrews, Held & Malloy, Ltd.

(57) ABSTRACT

The present disclosure describes a garment comprising a mobility-enhancing pleat positioned on the upper-arm portion of a sleeve. The pleat may be configured to move between a closed position, in which an outer layer lies substantially flat against the sleeve, and an open position, in which the outer layer is configured to provide the upper-arm portion of the sleeve with an increased surface area. Due to the increased surface area, the wearer is not restricted when reaching forward or upward and the sleeve is prevented from riding up so as to expose the wrists or lower arms of the wearer. Moreover, when the pleat is in an open position, the interior of the garment is not exposed. Accordingly, the pleat will not compromise a fire-resistant garment.

17 Claims, 11 Drawing Sheets

(56) References Cited

U.S. PATENT DOCUMENTS

| | | | | |
|---|---|---|---|---|
| 5,163,183 | A * | 11/1992 | Smith | A41D 13/02 2/458 |
| 5,170,506 | A | 12/1992 | Lewis, Jr. et al. | |
| 6,895,597 | B1 | 5/2005 | Rakic | |
| 2006/0162050 | A1 | 7/2006 | Kaufman et al. | |
| 2016/0029702 | A1* | 2/2016 | Griffin | A41B 1/08 2/116 |

* cited by examiner

Conventional Coverall

Pleated Coverall

GARMENT HAVING MOBILITY-ENHANCING ARM PLEAT

The present application claims priority to United States Provisional Patent Application No. 62/418,917, filed on Nov. 8, 2016, the entirety of which is incorporated herein by reference.

BACKGROUND

The present disclosure generally relates to clothing, and more specifically to a garment having a mobility-enhancing arm pleat.

In various work environments coveralls may be worn to provide protection from harmful materials that may be encountered. In many work environments, the coveralls must also be fire resistant. At the same time, it is often important that a worker be able to raise his or her arms upward or to reach forward. In some instances, the coverall may restrict a worker from moving in these ways. Other times, the sleeves of a coverall may "ride up" so as to expose the wearer's wrists and lower arms to the work environment. The use of mobility-enhancing stretch panels, such as those described in U.S. patent application Ser. No. 14/645,508, the entirety of which is incorporated herein by reference, on such garments may be undesirable because stretch panels typically provide a lesser degree of protection against harmful materials and are not fire resistant.

Accordingly, it is an object of the present disclosure to provide a garment, such as a coverall (although any garment having sleeves for a wearer's arms, e.g. shirts, jackets, etc. are contemplated as falling within the scope of the invention), having a mobility-enhancing arm pleat. In particular, it is an object of the present disclosure to provide a garment having a mobility-enhancing arm pleat that preserves the protective and fire-resistant properties of the garment.

SUMMARY

The present disclosure provides a garment configured to provide significant improvements in a wearer's comfort, performance, and mobility over a predefined range of motions.

An embodiment of the present disclosure is directed to a garment comprising a mobility-enhancing arm pleat. In particular the garment comprises a shirt portion comprising a sleeve, the sleeve having an upper-arm portion and a lower-arm portion. A mobility-enhancing pleat is positioned on the upper-arm portion of the sleeve.

For example, the pleat may span longitudinally along the upper-arm portion of the sleeve between a first end and a second end. The first end may coincide with, or abut, a conventional seam that connects a sleeve to the base of a shirt. For example, the first end of the pleat may coincide with, or abut, a front seam that connects the sleeve to the front face of the shirt. Alternatively, the first end of the pleat may coincide with, or abut, a rear seam that connects the sleeve to the rear face of the shirt. The second end may be located above the longitudinal midpoint of the arm.

In some embodiments, the sleeve may be integral with at least a portion of the rear face of the garment. When the sleeve is integral with the rear face of the garment, the rear seam is absent. A garment comprising both (a) the mobility-enhancing pleat of embodiments disclosed herein and (b) a sleeve that is integral with the rear face of the garment, has been found to provide a significantly improved protection for a wearer throughout a range of motions, including reaching forward and up, bending over, and kneeling and twisting.

In some embodiments, the pleat may be configured to move between a closed position, in which an outer layer lies substantially flat against the sleeve, and an open position, in which the outer layer is configured to move away from the sleeve to provide the upper-arm portion of the sleeve with an increased exterior surface area. When a wearer reaches upward or forward, for example, the pleat is configured to move into an open position. Due to the increased surface area of the sleeve provided by the pleat in the open position, the wearer is not restricted and the sleeve will be prevented from riding up so as to expose the wrists or lower arms of the wearer to the outside environment. When a wearer is not reaching in a manner that brings the pleat into an open position, the pleat may be biased toward the closed position.

Moreover, the pleat may be formed such that when the pleat is in an open position, the interior of the garment is not exposed. Indeed, in some embodiments, the material used in the pleat may be the same material as that of the sleeve. Accordingly, when in the open position, the pleat may provide the upper-arm portion of the sleeve with the same degree of protection as when the pleat is in the closed position.

Additional features and advantages will be set forth in the detailed description which follows, and in part will be readily apparent to those skilled in the art from the description or recognized by practicing the various embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE DISCLOSURE

Figure 1A:
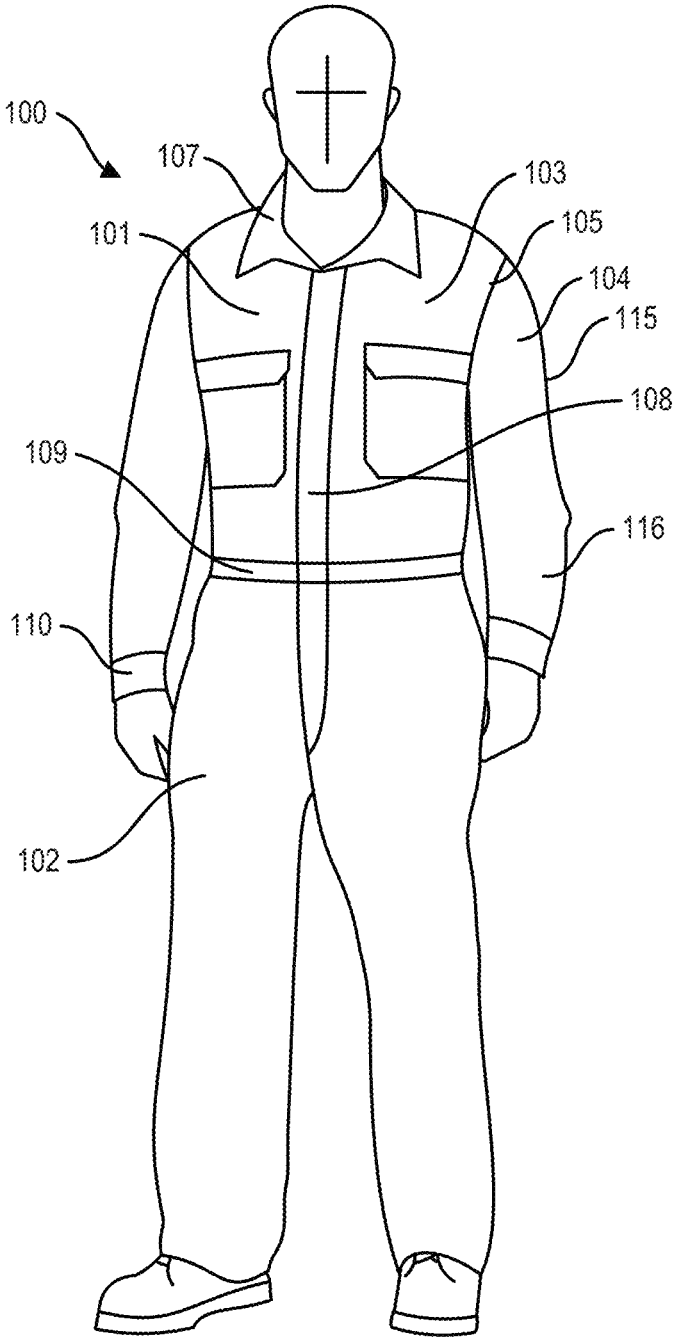
FIG. 1A is a front view of a coverall in accordance with embodiments of the disclosure.

Reference will now be made in detail to certain embodiments, examples of which are illustrated in the accompanying drawings. Whenever possible, the same reference numerals will be used throughout the drawings to refer to the same or like parts.

As an initial matter, the terms "shirt portion" and "shirt" are used interchangeably throughout the disclosure to refer to any garment having at least a portion that is designed to cover the upper body (i.e., the portion of the body above the waist) of a wearer. Therefore, while the illustrated embodiments show coveralls, which have both a shirt portion and a pants portion, the present disclosure is intended to cover shirts, jackets, and the like which do not have an integral pants portion.

FIG. 1A illustrates a front view of a coverall in accordance with an embodiment of the disclosure. Referring to FIG. 1A, there is shown a coverall 100 that has a shirt portion 101 and a pant portion 102. The shirt portion comprises a front face 103 and a pair of left and right sleeves 104. Each of the left and right sleeves 104 is connected to the front face 103 of the garment by a front seam 105. The shirt portion 101 also comprises a collar 107, a front entry opening 108, a waistband 109, and wrist cuffs 110. The coverall 100 may be worn to protect the wearer from various environmental hazards such as liquids, solids, gases, heat/flame, etc. In some embodiments, the coverall 100 may be insulated, for example, to protect against cold. Embodiments of the coverall 100 may be configured to be fire-resistant.

The front entry opening 108, when opened, allows the user to don and doff the coverall 100. When closed, the front entry opening 108 secures the coverall 100 around the user 100 and provides protection for the front area of the user. The wrist cuffs 110 can allow the sleeve to fit snugly around the wrists of the user to allow free use of the user's hands as well as possibly protecting the user's arms from any environmental contaminants (solid, liquid, gas) that may be in the area of the user's hands. In other embodiments, such as where an additional level of protection against the environment may be necessary, the coverall may comprise elastically sealable wrist cuffs or the like.

Various embodiments of the coverall 100 may have ankle cuffs for a snug fit and protection, much like the wrist cuffs 110 described above. Various embodiments may also have reinforced areas for portions of the coverall 100 that may be exposed to additional wear such as the elbow areas and/or the knee areas. Some embodiments may also have a belt (full or partial), which may be elastic in some embodiments, or other fasteners to cinch the coverall at or near the waist of the wearer.

In some embodiments, the garment may not be a coverall but may instead be an independent shirt. The shirt may have some type of fastener to keep the shirt in place. The fastener may be, for example, elastic at the bottom of the shirt portion, or another type of (full or partial) belt built into the shirt portion, or other means of cinching the shirt portion to the body of the user, or one or more loops that may go from the shirt portion between the legs to be fastened to the other side of the shirt portion. The fastener may use hook and loop, buttons, zippers, snaps, hooks, and any of the many other fastening devices used for various fastening purposes, whether with respect to clothes or other objects.

Additionally, while an entry opening 108 has been described to be in the front, various embodiments of the disclosure need not be so limited. For example, the entry opening can be in the back, or in the side. Also, the entry opening can be vertical or diagonal. Some embodiments may also have a horizontal entry opening. The entry opening may use one or more of fasteners such as hook and loop, buttons, zippers, snaps, hooks, and any of the many other fasteners used for various fastening, whether with respect to clothes or other objects.

Figure 1B:
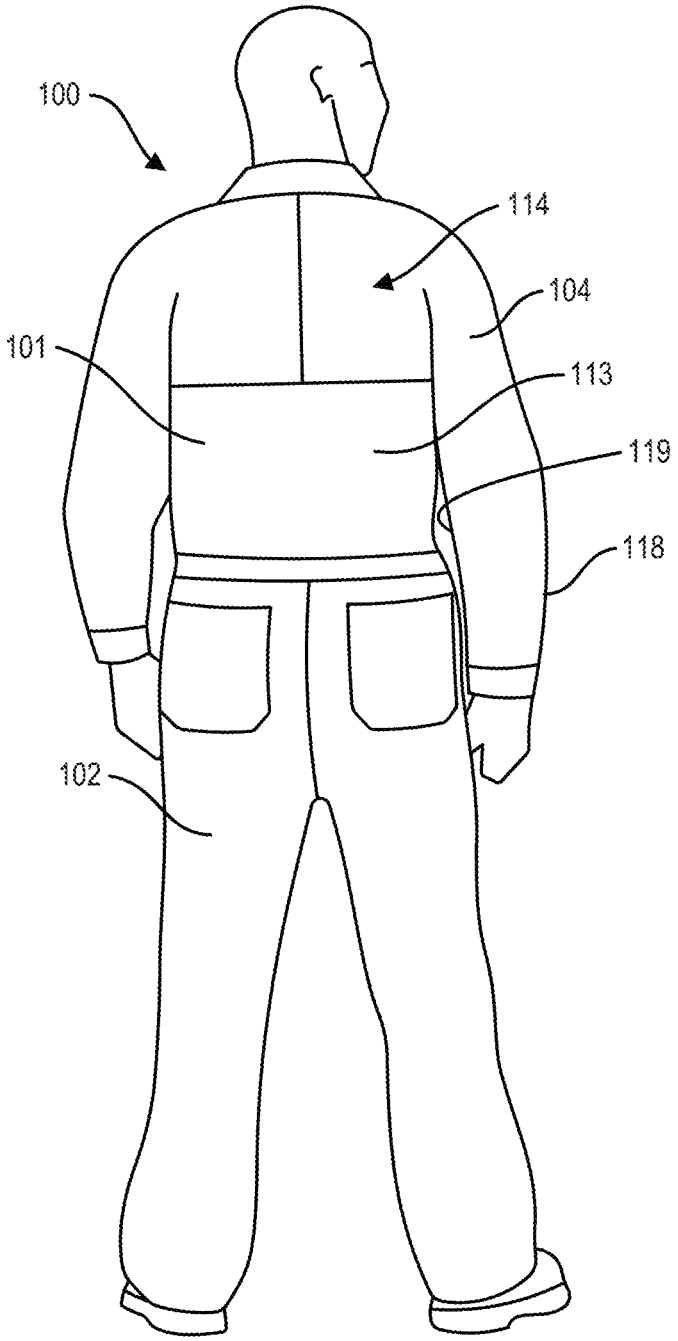
FIG. 1B is a rear view of the coverall in which the sleeve is integral with the rear face of the shirt portion in accordance with embodiments of the disclosure.

FIG. 1B illustrates a rear view of a coverall 100 in accordance with an embodiment of the disclosure. Referring to FIG. 1B, there is shown a coverall 100 that has a shirt portion 101 and a pant portion 102. The shirt portion comprises a rear face 113 and a pair of left and right sleeves 104. The shirt portion 101 also comprises an extended sleeve portion 114. As shown in the illustrated embodiment, each of the sleeves 104 may be integral with a portion of the rear face 113 of the shirt, to produce an extended sleeve portion 114. As a wearer performs the range of motions, the extended sleeve portion 114 provides additional fabric located behind the shoulder but integral with the sleeve 104, which provides significant improvements in a wearer's comfort, performance, and mobility, especially when combined with the mobility-enhancing pleat disclosed herein. When viewed from the front, however, the shirt portion 101 may have the appearance of a standard work shirt (see for example FIG. 1A).

The extended sleeve portion may take on any number of shapes or formats. In the embodiment illustrated in FIG. 1B, the rear face 113 of the shirt is divided into a lower panel and a pair of upper panels. The lower panel and the upper panels are divided by a horizontal seam. In other embodiments, however, the lower panel and the upper panels may be divided by a seam having a different configuration. In the embodiment illustrated in FIG. 1B, the pair of upper panels are divided from one another by a vertical seam. In other embodiments, however, the pair of upper panels may be divided by a seam having a different configuration. In alternative embodiments, the pair of upper panels may be replaced by a single panel that spans between the left sleeve and the right sleeve.

Figure 2A:
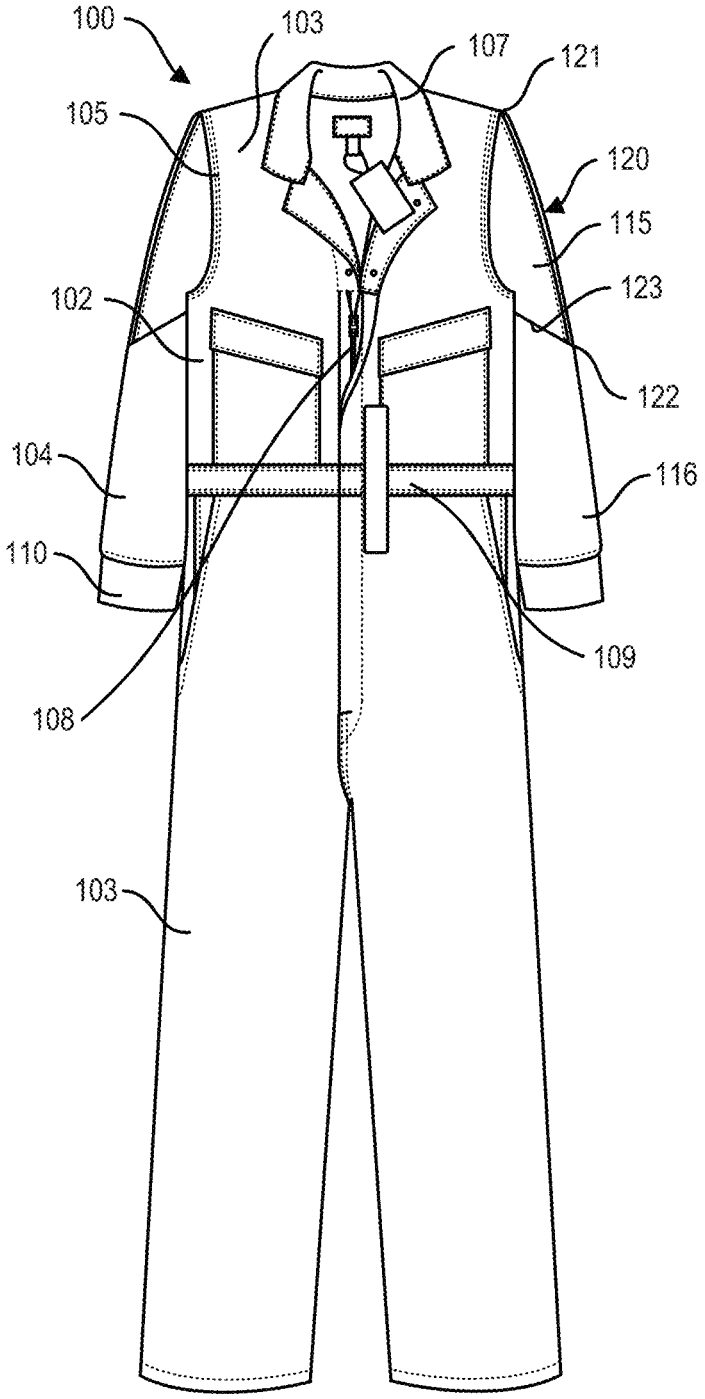
FIG. 2A is a front view of a coverall in accordance with embodiments of the disclosure.
Figure 2B:
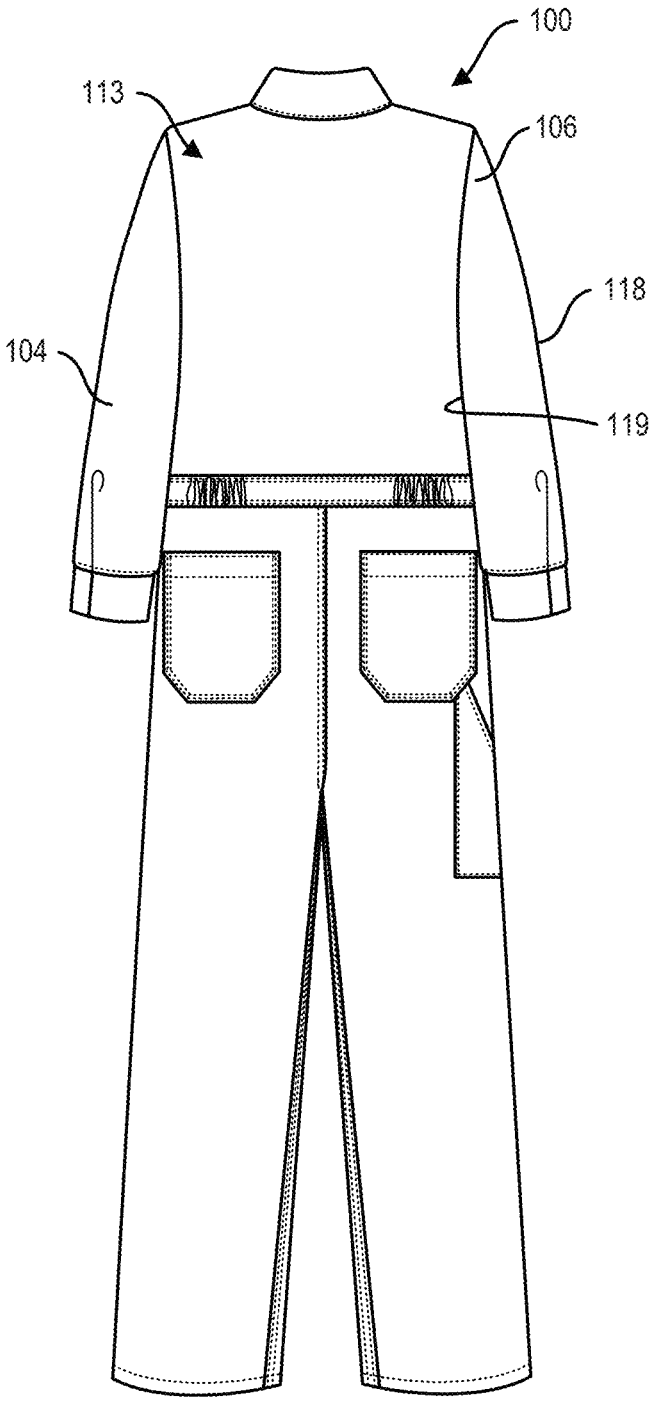
FIG. 2B is a rear view of the coverall in which the sleeve has a conventional connection with the rear face of the shirt portion in accordance with embodiments of the disclosure.
Figure 2C:
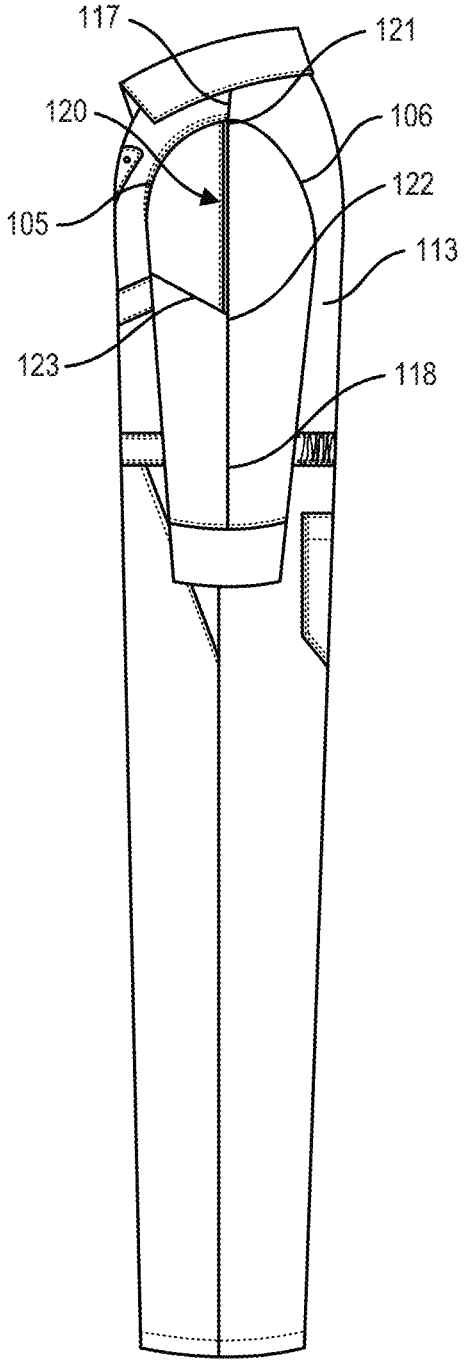
FIG. 2C is a side view of the coverall showing an upper arm pleat in a closed position in accordance with embodiments of the disclosure.
Figure 2D:
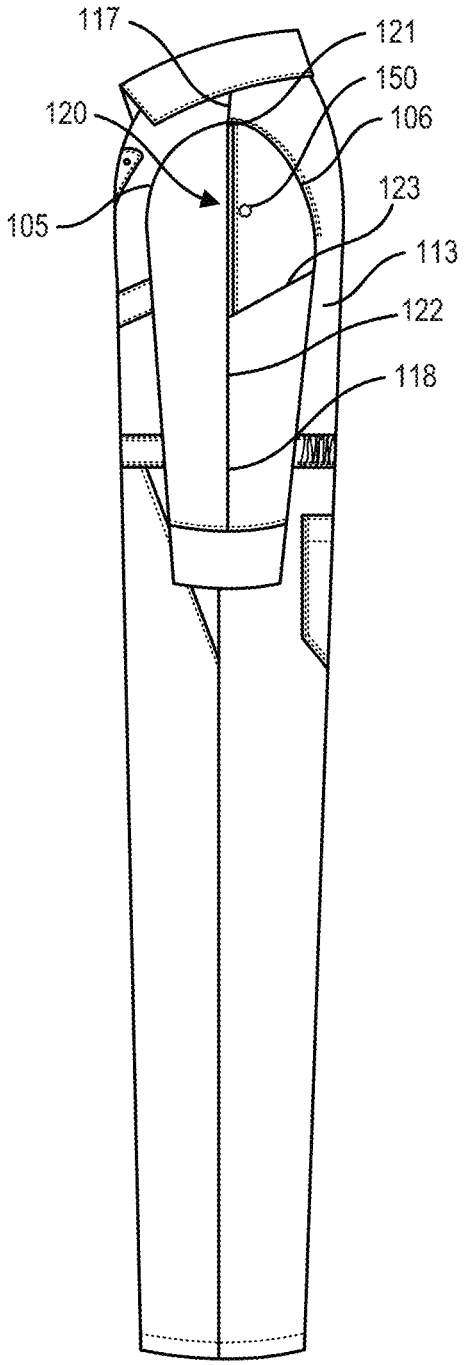
FIG. 2D is a side view of an alternative embodiment, in which the first end of the pleat coincides with a seam that connects the sleeve to the rear face of the shirt portion.

In other embodiments, such as that illustrated in FIGS. 2A through 2C, the shirt portion 101 may comprise a conventional connection between the rear face 113 and the sleeve 104, wherein each of the left and right sleeves 104 may be connected to the rear face 113 of the garment by a conventional rear seam 106.

The sleeves 104 provide protection for a wearer's arms. For purposes of the present disclosure, each of the sleeves 104 is considered to have a longitudinal axis extending between (a) the point where the front seam 105 (and the rear seam 106, if present) meets the shoulder seam 117 and (b) the top of the wrist cuff 110. Further, each of the sleeves 104 is considered to be divided into an upper-arm portion 115 and a lower-arm portion 116. The upper-arm portion 115 and the lower-arm portion 116 are divided at the midpoint of the longitudinal sleeve axis.

In some embodiments, each of the sleeves 104 comprises an outer seam 118 that runs longitudinally along the outside of the sleeve from the shoulder to the top of the wrist cuff. Similarly, in some embodiments, each of the sleeves 104 comprises an inner seam 119 that runs longitudinally along the underside of the sleeve from (a) the point where the front seam 105 (and the rear seam 106, if present) meets the side seam of the shirt, i.e. the seam that attaches the front face 103 to the rear face 113, and (b) the top of the wrist cuff 110.

Figures 1C, 1D:
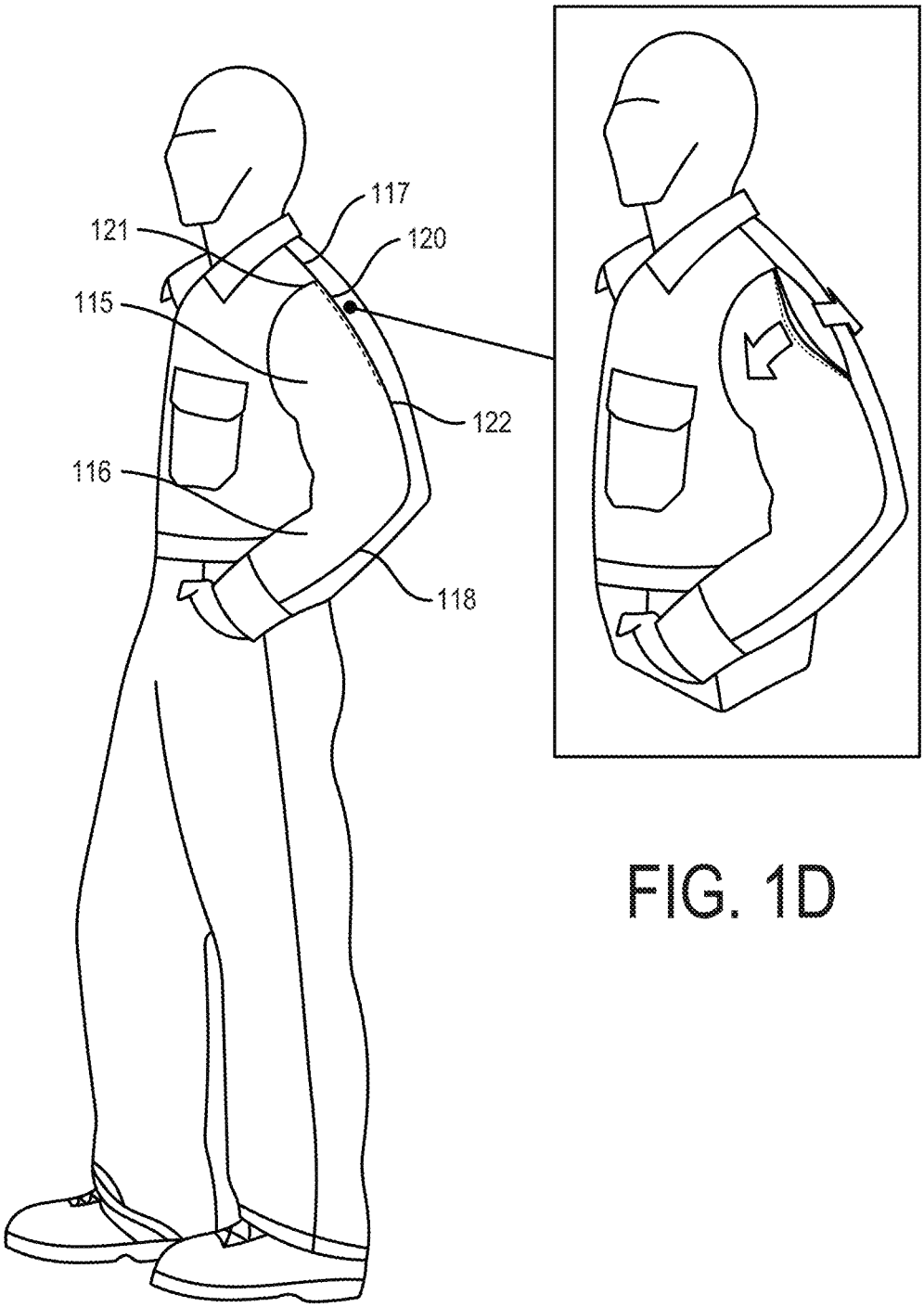
FIG. 1C is a side view of the coverall showing an upper arm pleat in a closed position in accordance with embodiments of the disclosure.
FIG. 1D is a perspective view of the shirt portion of a coverall showing an upper-arm pleat in an open position in accordance with embodiments of the disclosure.

FIGS. 1C and 2C illustrate a side view of coveralls in accordance with embodiments of the disclosure. FIGS. 1C and 2C show a mobility-enhancing pleat 120 positioned on an upper-arm portion 115 of the sleeve 104. More particularly, the pleat 120 is positioned along a portion of the outer seam 118 of the sleeve.

The mobility-enhancing pleat 120 may span between a first end 121 and a second end 122. In some embodiments, the pleat 120 may span between about 3 to about 20 inches in length, alternatively about 4 to about 18 inches in length, alternatively about 5 to about 16 inches in length, alternatively about 10 inches in length. The length of the pleat 120 may vary depending, for example, on the size of the coverall (which will affect the length of the sleeve), the degree of mobility enhancement desired, etc.

In some embodiments, such as that illustrated in the Figures, the first end 121 of the pleat may coincide with the front seam 105, which, as previously described, attaches the sleeve 104 with the front face 101 of the shirt. Alternatively, the first end 121 of the pleat may coincide with the rear seam 106, which, as previously described, attaches the sleeve 104 with the rear face 113 of the shirt. These configurations are desirable because they minimize the number of additional seams that are required by incorporation of the pleat 120. In alternative embodiments, however, the first end 121 of the pleat may be located a short distance below the front seam 105 or the rear seam 106.

The second end 122 of the pleat is desirably located above the longitudinal midpoint of the sleeve. Accordingly, the pleat desirably does not span onto the lower-arm portion 116 of the sleeve. In alternative embodiments, however, the second end 122 of the pleat may be located at or slightly below the longitudinal midpoint of the sleeve. Because the second end 122 of the pleat does not align with a conventional shirt seam, the second end of the pleat may comprise a seam 123 that extends across the sleeve 104. This seam 123 may span between an outer sleeve seam 118 and an inner sleeve seam 119.

In some embodiments, the seam 123 may extend laterally across the sleeve, e.g. perpendicular to the longitudinal axis of the sleeve. In other embodiments, the seam 123 may be positioned at an angle between about 20 and about 90 degrees from the longitudinal axis of the sleeve, alternatively between about 30 and about 70 degrees. For example, as illustrated in FIGS. 2A and 2B, the seam 123 may angle upward from the longitudinal axis of the sleeve at an angle so as to approach the armpit of the garment. This may be desirable because it minimizes the footprint of the pleat 120 on the sleeve 104.

The mobility-enhancing pleat 120 may take on any number of configurations, so long as the pleat is configured to (a) lay substantially flat against the sleeve 104 when in a closed position and (b) expand so as to provide the upper-arm portion 115 of the sleeve with an increased circumference and surface area when a wearer reaches upward and/or frontward.

Figure 3:
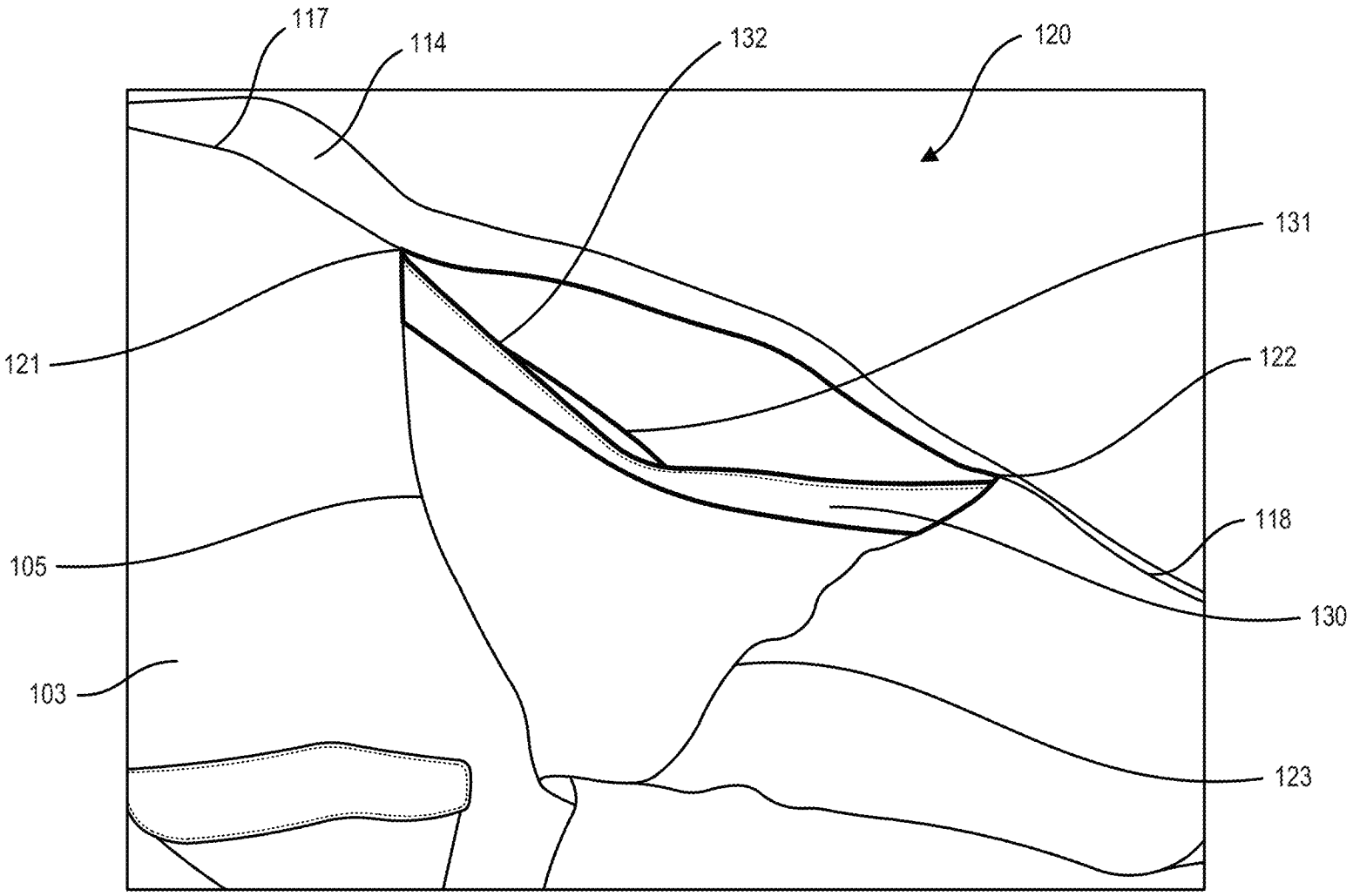
FIG. 3 is a perspective view of the upper-arm portion of a sleeve, showing a portion of a mobility-enhancing pleat in a partially open position in accordance with embodiments of the disclosure.
Figure 4:
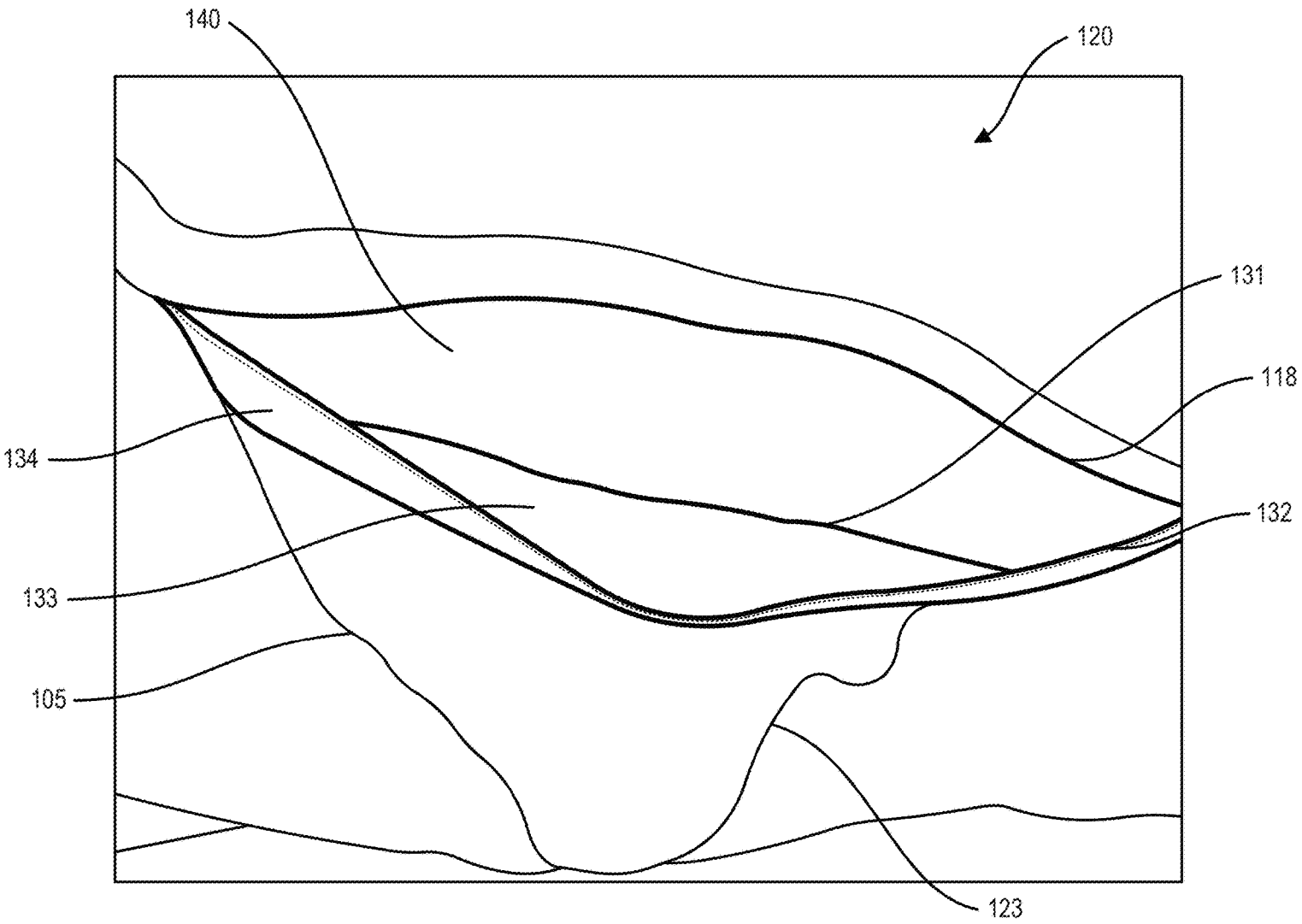
FIG. 4 is a perspective view of a mobility-enhancing pleat in a partially open position in accordance with embodiments of the disclosure.

In some embodiments, such as that shown in FIGS. 3 and 4, the pleat may comprise an outer layer 130. The pleat 120 may be configured to move between a closed position, in which the outer layer 130 lies substantially flat against the sleeve 104, such as shown in FIGS. 1C and 2C, and an open position, in which the outer layer is configured to move away from the sleeve to provide the upper-arm portion of the sleeve with an increased exterior surface area, as shown in FIGS. 3 and 4.

As shown in FIGS. 3 and 4, the outer layer 130 comprises an inner boundary 131 and an outer edge 132. In some embodiments, such as the illustrated embodiments, the outer edge 132 is aligned with the outer sleeve seam 118. Additionally, the inner boundary 131 may not be visible when the pleat 120 is in the closed position. In this way, the pleat 120 may be barely noticeable when in the closed position, as shown in FIGS. 1C and 2C.

The outer layer 130 may comprise an interior portion 133 and an exterior portion 134, with the interior portion and the exterior portion being divided by the outer edge 132.

The interior portion 133 of the outer layer spans between the inner boundary 131 and the outer edge 132. In some embodiments, for example, the interior portion 133 may have a width between about 0.5" and about 5" inches from the inner boundary 131 to the outer edge 132, alternatively between about 1" and about 4" inches, alternatively between about 1.5" and about 3" inches.

When in a closed position, it is desirable that the interior portion 133 lays substantially flush against an underlying sleeve portion 140 so that the pleat 120 is hardly noticeable. In the illustrated embodiments, the underlying sleeve portion 140 spans between the outer sleeve seam 118 and the inner boundary 131. So as to avoid the inclusion of unnecessary fabric, it is desirable that the underlying sleeve portion 140 not extend beyond the inner boundary 131. Therefore, the underlying sleeve portion 140 may have a width (for instance between the outer sleeve seam 118 and the inner boundary 131) that is the same as the width of the interior portion 133 of the outer layer.

The interior portion 133 is connected to the sleeve at the inner boundary 131. In some embodiments, the interior portion 133 may be integral with the underlying sleeve portion 140. For example, the interior portion 133 of the outer layer may comprise the same fabric panel as the underlying sleeve portion 140, with the inner boundary 131 being a fold line that separates the interior portion 133 from the underlying sleeve portion 140. In other embodiments, the interior portion 133 may be a separate panel that is attached to the underlying sleeve portion 140 at the inner boundary 131. For instance, the inner boundary 131 may be a seam between the interior portion 133 of the outer layer and the underlying sleeve portion 140.

The exterior portion 134 of the outer layer spans between the outer edge 132 and a bottom seam 135. In some embodiments, such as the illustrated embodiments, the bottom seam may coincide with an inner seam of the sleeve 119. This configuration is shown, for example, in FIG. 5. This configuration is desirable because it minimizes the number of additional seams that are required by incorporation of the pleat 120. Alternatively, the bottom seam 135 may be positioned at another location around the circumference of the sleeve. For instance, the bottom seam 135 may be positioned at a location between the inner seam of the sleeve 119 (or the location that would correspond with an inner seam of the sleeve if one is not present) and the inner boundary 131 of the outer layer. In some embodiments, therefore, the exterior portion 134 may span beyond, and conceal, the inner boundary 131.

Figure 5:
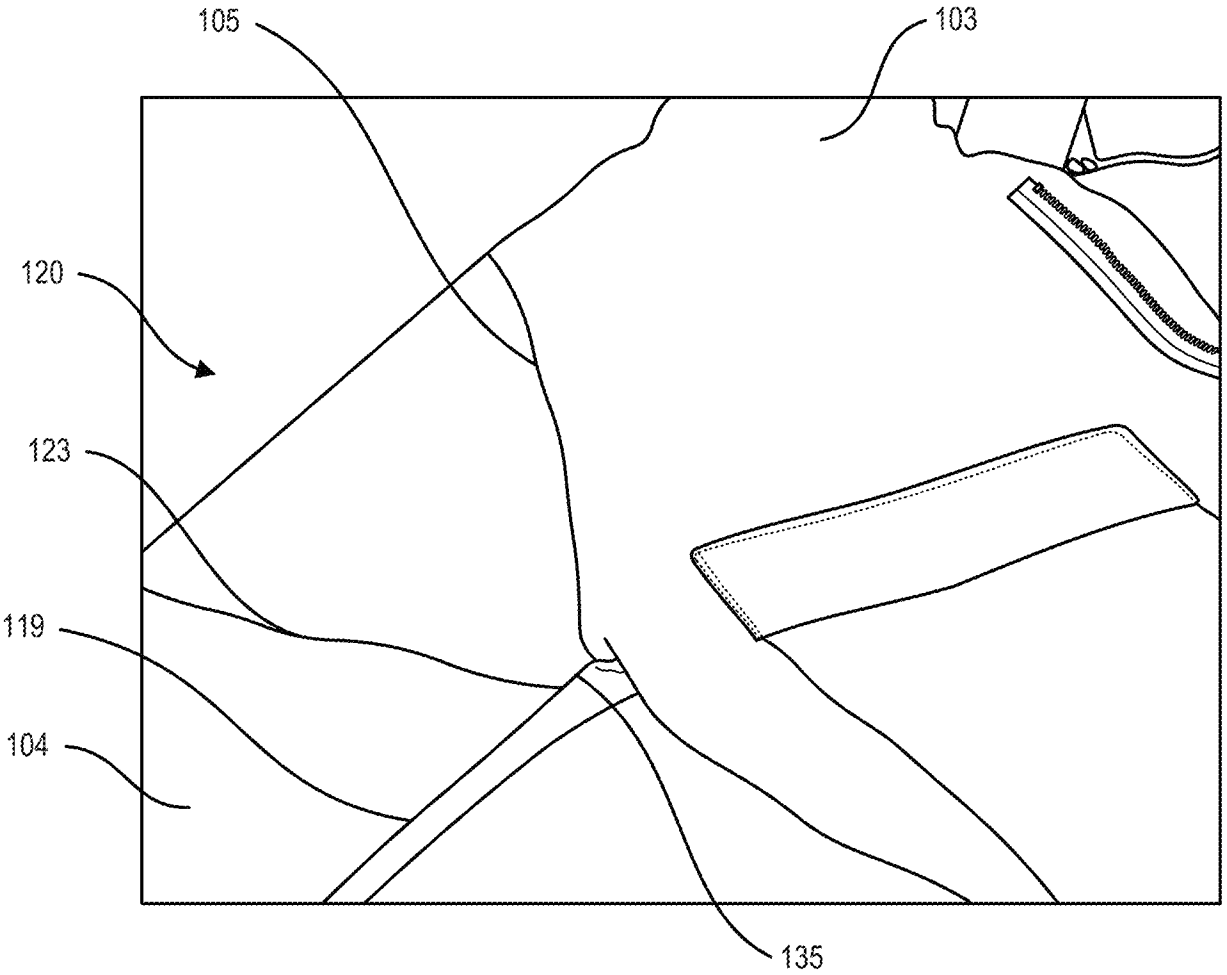
FIG. 5 is a perspective view of the upper-arm portion of a sleeve, showing a portion of a mobility-enhancing pleat in accordance with embodiments of the disclosure.

In some embodiments, the exterior portion 134 of the outer layer may narrow in length as it approaches the bottom seam 135. For instance, as shown in FIGS. 3 and 5, and described above, the seam 123 may meet the inner sleeve seam 119 at or near the armpit.

The exterior portion 134 is connected to the interior portion 133 at the outer edge 132. In some embodiments, the exterior portion 134 may be integral with the interior portion 133. For example, the exterior portion 134 of the outer layer may comprise the same fabric panel as the interior portion 133, with the outer edge 132 being a fold line. In other embodiments, the exterior portion 134 may be a separate panel that is attached to the interior portion 133 at the outer edge 132. For instance, the outer edge 132 may be a seam between the exterior portion 134 and the interior portion 133. Even where the outer edge 132 is a fold line, it may be desirable to sew the exterior portion 134 and the interior portion 133 together at or near the outer edge in order to provide additional weight to the outer edge, which may assist with biasing the pleat toward a closed position.

As previously noted, the pleat 120 moves between a closed position and an open position. When a wearer is at rest, i.e. not moving, the pleat 120 is maintained in a closed position. When in the closed position, it is desirable that the pleat 120 lay substantially flat against the sleeve 104. For instance, the outer layer 130 may lie substantially flat against the underlying sleeve portion 140. When the pleat 120 is arranged as shown in FIG. 3, for example, this brings the outer edge in substantial alignment with the outer sleeve seam 118.

As a wearer of the garment 100 reaches, particularly in an upward or outward direction, the pleat is caused to move from the closed position to an open position. FIG. 4 illustrates an embodiment of a pleat 120 in an open position. As shown in the Figure, when moved toward the open position, the outer layer 130 of the pleat is moved away from the sleeve 104. For instance, the outer layer 130 may be pulled away from the underlying sleeve portion 140. In this way, the circumference and surface area of the upper-arm portion of the sleeve 115 is increased. In the embodiment shown in FIGS. 3 and 4, for example, the outer flap 130 opens toward the front of the garment, exposing both the interior portion 133 of the outer layer and the underlying sleeve portion 140. When sufficiently open, the inner boundary 131 of the outer layer may also be exposed. In alternative embodiments, the outer layer 130 may be positioned on the rear of the sleeve 104, such that the outer flap opens toward the rear of the garment rather than the front.

The pleat 120 may be caused to open only to the extent necessary to provide a wearer with sufficient material in the upper-arm sleeve 115 to perform a movement. For instance, when fully opened (e.g. such that the interior portion 133 of the outer layer and the underlying sleeve portion 140 form an angle of about 180 degrees about the inner boundary 131), the pleat is capable of increasing the circumference of the upper-arm portion of the sleeve 115 by a certain amount (e.g. the sum of the width of the interior portion 133 of the outer layer and the width of the underlying sleeve portion 140). However, in many instances, the pleat 120 may only open a percentage of its total capability, with the percentage corresponding to the amount of tension being placed on the upper-arm portion of the sleeve 115 by the wearer's movement. In FIG. 4, for instance, the pleat 120 is open between about 50% and about 75% of its total capability. Importantly, when the pleat 120 is in an open position, the upper-arm portion of the sleeve 115 still provides protection for a wearer against the environment. For instance, when the pleat 120 is in an open position, there is no underlying aperture in the garment through which a wearer will become exposed to the outside environment.

In some embodiments, each of the various panels that make up the pleat 120 may be made of the same material as other parts of the garment 100 and in some instances the whole of the garment. For example, each of the various panels that make up the pleat 120 may be made of the same material as the rest of the sleeve 104, or at least the same material as the lower portion 116 of the sleeve (the wrist cuff 110 may be made of a different material). Notably, no stretch panels are required for the pleat 120 to provide an enhanced mobility.

In some embodiments, the garment may bias the pleat 120 toward the closed position and/or maintain the pleat in a closed position through the inclusion of one or more fastening devices. For example, the pleat 120 may comprise cooperative magnets or hook and loop fasteners 150 that hold the pleat in a closed position. However, the force of the one or more fastening devices 150 should be easily overcome when a wearer reaches forward or upward. For example, the pleat fastener 150 may be configured to fasten lightly enough that the pleat opens readily when a wearer move his or her arm in an outward or upward direction. Similarly, when a wearer ceases the reaching motion, the pleat fastener 150 may bias the pleat to a closed position.

In some embodiments of the present disclosure, the garment 100 may be coveralls or other protective clothing. These garments may be fire-resistant and/or fire-proof. A fire-proof material can also be said to be fire-resistant.

In some embodiments of the present disclosure, the garment 100 may be configured to withstand laundering under conditions that are harsher than those used in home laundering processes. For example, in some embodiments, it may be important that the fabric or fabrics that make up the garment are able to withstand industrial laundering. Many workers in a variety of fields obtain their work wear through a uniform rental program. The garments that are provided by uniform rental programs are washed by a process known as industrial laundering. Industrial laundering must meet a set of standards defined by ISO (the International Organization for Standardization) standards such as ISO 15797 and ISO 30023. For example, in contrast to home laundering processes, which typically take place at about 120° F., industrial laundering takes place at a temperature of at least 150-160° F. Industrial laundering also requires the use of stronger chemicals than those used in a home laundering process. Chemicals used in industrial laundering typically include strong alkali components and strong surfactants. Acids may also be used to bring the pH of a garment to a level that will not irritate the skin. Many industrial laundering processes also employ additional steps that include treatment with agents such as bleaches and/or antichlor compounds. As a result, fabrics that are not configured to withstand the more extreme conditions of industrial laundering may often be destroyed by the process. It is contemplated that embodiments of the garments described herein may be provided to workers through a uniform rental program. Accordingly, embodiments of the garments may be configured to be capable of withstanding industrial laundering.

Figure 6:
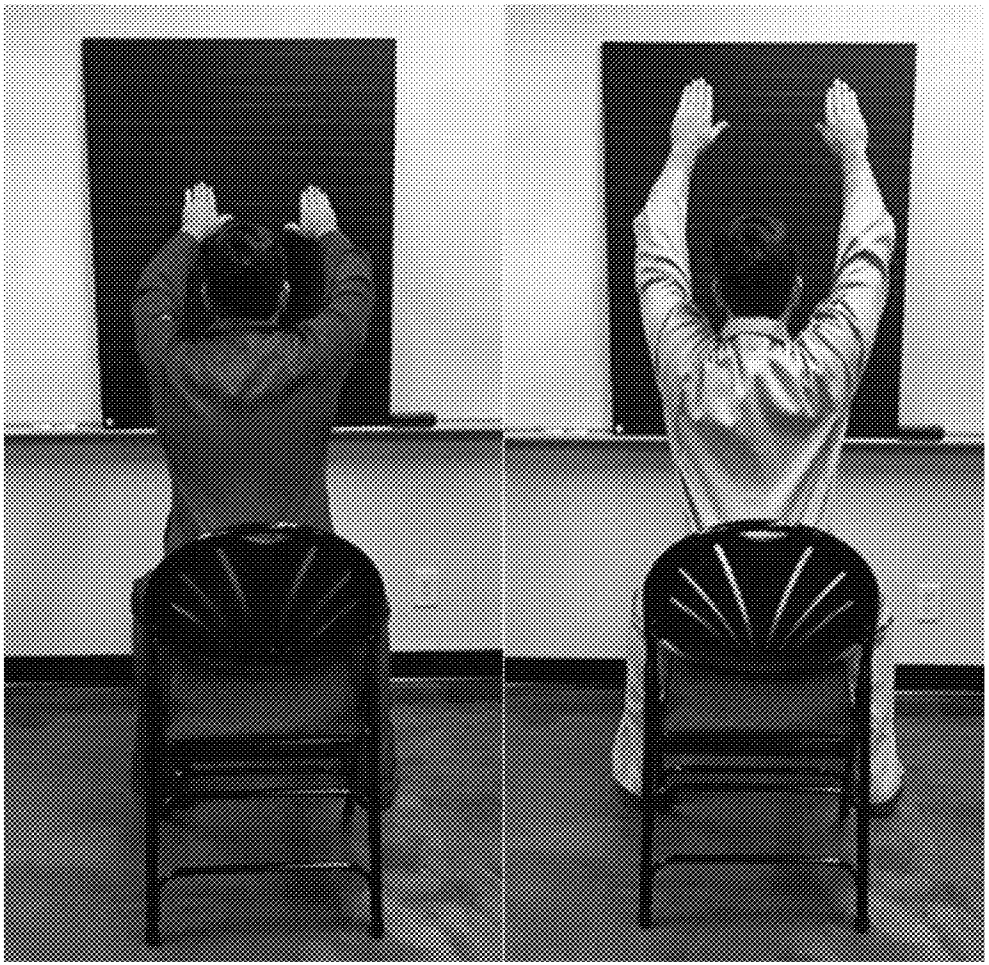
FIG. 6 is a rear view of mobility testing results comparing a conventional coverall garment (left) and a coverall garment comprising a mobility-enhancing pleat in accordance with an embodiment of the disclosure (right).

The pleat 120 of embodiments of the present disclosure has surprisingly been found to significantly enhance the mobility of a wearer, in particular with regard to an upward reach and a forward reach. For instance, wearer mobility testing has demonstrated that a coverall having the pleat 120 of an embodiment of the present disclosure on each arm has provided a significantly increased upward reach when compared against a conventional (non-pleated) coverall. Specifically, a number of subjects were asked to reach upward while wearing each of (1) the pleated coverall and (2) the conventional coverall. The height of each subject's reach was measured. Notably, the pleated coverall was found to increase the upward reach motion by an average of 3 inches compare to the conventional coverall. In one instance, illustrated in FIG. 6, the pleated coverall was seen to increase the upward reach motion by over 10 inches.

The pleat 120 of embodiments of the present disclosure may be configured to increase the upward reach motion of a wearer by at least 1 inch, alternatively at least 2 inches, alternatively at least 3 inches, alternatively at least 4 inches, alternatively at least 5 inches, alternatively at least 6 inches, alternatively at least 7 inches, alternatively at least 8 inches, alternatively at least 9 inches, alternatively at least 10 inches.

It can be seen that the described embodiments provide a unique and novel garment 100 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A garment comprising a mobility-enhancing arm pleat, the garment comprising:

a shirt portion comprising a sleeve, the sleeve comprising an upper-arm portion, a lower-arm portion, and an outer sleeve seam; and a mobility-enhancing pleat on the upper-arm portion of the sleeve, the pleat being located on the upper-arm portion of the sleeve and configured to move between a closed position, in which an outer layer of the pleat lies substantially flat against the sleeve, and an open position, in which the outer layer is configured to move away from the sleeve to provide the upper-arm portion of the sleeve with an increased exterior surface area;

wherein the outer layer comprises an interior portion and an exterior portion, the interior portion and the exterior portion being divided by an outer edge; and wherein the outer edge is aligned with the outer sleeve seam when the pleat is in a closed position.

2. The garment of claim 1, wherein the pleat spans between a first end and a second end.

3. The garment of claim 2, the garment further comprising a front seam that connects the sleeve to a front face of the shirt portion, wherein the first end coincides with the front seam.

4. The garment of claim 2, the garment further comprising a rear seam that connects the sleeve to the rear face of the shirt portion, wherein the first end of the pleat coincides with the rear seam.

5. The garment of claim 3, wherein the second end is located above a longitudinal midpoint of the sleeve.

6. The garment of claim 3, wherein the sleeve is integral with at least a portion of a rear face of the garment.

7. The garment of claim 1, the sleeve further comprising an inner sleeve seam, wherein the exterior portion of the outer layer spans between the outer edge and the inner sleeve seam.

8. The garment of claim 7, wherein the exterior portion of the outer layer is narrower at the inner sleeve seam than at the outer edge.

9. The garment of claim 1, further comprising an inner boundary, wherein the inner boundary is a fold line between the interior portion and an underlying sleeve portion.

10. The garment of claim 1, further comprising an inner boundary, wherein the inner boundary is a seam between the interior portion and an underlying sleeve portion.

11. The garment of claim 1, wherein the outer edge is a fold line.

12. The garment of claim 1, wherein the outer edge is a seam.

13. The garment of claim 1, further comprising one or more fasteners configured to bias the outer layer toward the closed position.

14. The garment of claim 1, wherein the garment is a coverall.

15. The garment of claim 14, wherein the garment is fire-resistant.

16. The garment of claim 1, in which the mobility-enhancing pleat is configured to increase an upward reach motion performed by a wearer of the garment by at least 3 inches.

17. The garment of claim 16, in which the mobility-enhancing pleat is configured to increase an upward reach motion performed by a wearer of the garment by at least 5 inches.

* * * * *